US011069503B2

(12) United States Patent
Saito et al.

(10) Patent No.: US 11,069,503 B2
(45) Date of Patent: Jul. 20, 2021

(54) ELECTRON GENERATING APPARATUS AND IONIZATION GAUGE

(71) Applicant: Canon Anelva Corporation, Kawasaki (JP)

(72) Inventors: Noriyuki Saito, Kawasaki (JP); Kyuma Iizuka, Hino (JP); Eriko Chida, Kawasaki (JP)

(73) Assignee: CANON ANELVA CORPORATION, Kawasaki (JP)

( * ) Notice: Subject to any disclaimer, the term of this patent is extended or adjusted under 35 U.S.C. 154(b) by 0 days.

(21) Appl. No.: 17/019,922

(22) Filed: Sep. 14, 2020

(65) Prior Publication Data

US 2021/0090840 A1 Mar. 25, 2021

(30) Foreign Application Priority Data

Sep. 19, 2019 (JP) ..... JP2019-170777

(51) Int. Cl.
*H01J 1/02* (2006.01)

(52) U.S. Cl.
CPC ..... *H01J 1/02* (2013.01)

(58) Field of Classification Search
CPC ..... H01J 1/02
See application file for complete search history.

(56) References Cited

U.S. PATENT DOCUMENTS 5,497,006 A * 3/1996 Sferlazzo ..... H01J 27/14 250/427
2011/0241575 A1* 10/2011 Caiafa ..... H05G 1/32 315/379

FOREIGN PATENT DOCUMENTS

JP H07151816 A 6/1995

* cited by examiner

*Primary Examiner* — Joseph L Williams
(74) *Attorney, Agent, or Firm* — Buchanan Ingersoll & Rooney PC

(57) ABSTRACT

An electron generating apparatus includes a filament, a power supply configured to supply power to the filament so as to make the filament emit an electron, and a controller configured to repeatedly detect a value having a correlation with power supplied from the power supply to the filament, determine whether a state of the filament satisfies a notification condition, by using a plurality of detected values, and perform notification when the state satisfies the notification condition.

19 Claims, 4 Drawing Sheets

ELECTRON GENERATING APPARATUS AND IONIZATION GAUGE

BACKGROUND OF THE INVENTION

Field of the Invention

The present invention relates to an electron generating apparatus and an ionization gauge.

Description of the Related Art

There is available an electron generating apparatus that generates electrons by energizing a filament. A certain type of filament deteriorates in surface state with use, and the number of electrons generated from the filament gradually decreases. In order to constantly maintain the number of electrons generated from a filament, it is necessary to increase the power supplied to the filament. On the other hand, there is a limit on the maximum value of power that can be supplied from a power supply to a filament. Accordingly, when the magnitude of power supplied to the filament reaches the limit, a necessary number of electrons cannot be generated from the filament afterward. As a consequence, the filament needs to be replaced. There is another type of filament that evaporates with use and finally breaks. It is necessary to replace the filament before such breakage.

Japanese Patent Laid-Open No. 7-151816 discloses a method for grasping the timing of filament replacement. More specifically, Japanese Patent Laid-Open No. 7-151816 discloses a technique of notifying filament replacement when a measured filament current value reaches the upper or lower limit value set in advance upon comparison between them.

However, an apparatus like that disclosed in Japanese Patent Laid-Open No. 7-151816 may notify filament replacement in spite of the fact that the filament has not deteriorated.

SUMMARY OF THE INVENTION

The present invention provides a technique advantageous in determining the timing of filament replacement with higher accuracy.

A first aspect of the present invention provides an electron generating apparatus comprising: a filament; a power supply configured to supply power to the filament so as to make the filament emit an electron; and a controller configured to repeatedly detect a value having a correlation with power supplied from the power supply to the filament, determine whether a state of the filament satisfies a notification condition, by using a plurality of detected values, and perform notification when the state satisfies the notification condition.

A second aspect of the present invention provides an ionization gauge comprising an electron generating apparatus as defined as the first aspect.

A third aspect of the present invention provides an electron generating apparatus comprising: a filament; a power supply configured to supply power to the filament so as to make the filament emit an electron; and a controller configured to perform notification to prompt to replace the filament based on a value having a correlation with power supplied from the power supply to the filament, wherein the controller does not perform the notification until a lapse of a predetermined time since the power supply is turned on.

A fourth aspect of the present invention provides an ionization gauge comprising an electron generating apparatus as defined as the third aspect.

Further features of the present invention will become apparent from the following description of exemplary embodiments with reference to the attached drawings.

BRIEF DESCRIPTION OF THE DRAWINGS

FIGS. 2A and 2B are graphs each showing a change in filament current value If immediately after a filament heating power supply is turned on;

DESCRIPTION OF THE EMBODIMENTS

Figure 1:
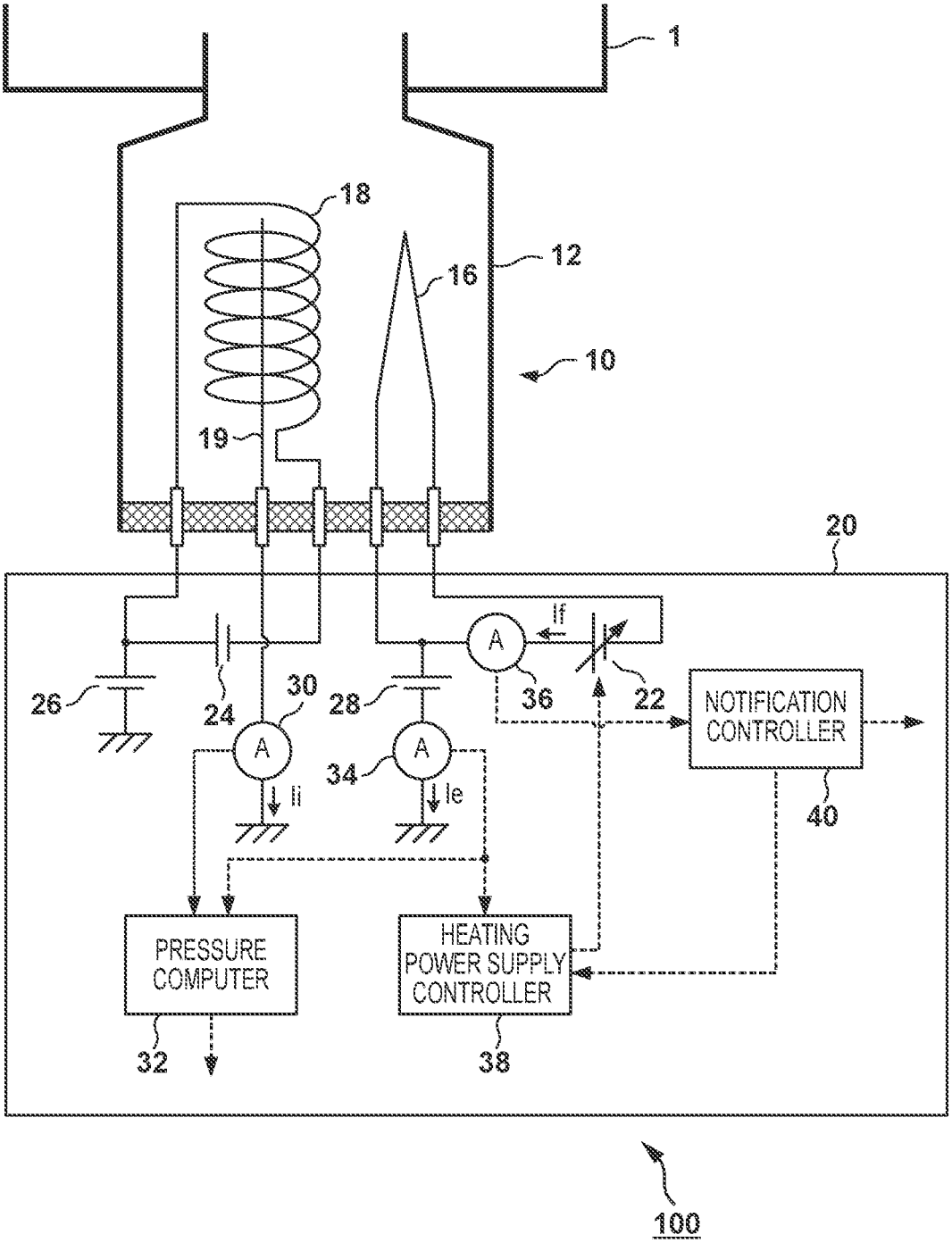
FIG. 1 is a view showing the arrangement of an electron generating apparatus according to an embodiment of the present invention.

Hereinafter, embodiments will be described in detail with reference to the attached drawings. Note, the following embodiments are not intended to limit the scope of the claimed invention. Multiple features are described in the embodiments, but limitation is not made an invention that requires all such features, and multiple such features may be combined as appropriate. Furthermore, in the attached drawings, the same reference numerals are given to the same or similar configurations, and redundant description thereof is omitted.

FIG. 1 shows the arrangement of an electron generating apparatus 100 according to an embodiment of the present invention. In the case shown in FIG. 1, the electron generating apparatus 100 is configured as an ionization gauge. However, the electron generating apparatus according to the present invention may be applied to other apparatuses, for example, a heating apparatus that heats an object by generated electrons and an electron beam irradiation apparatus that generates an electron beam and irradiates an object with the electron beam.

The electron generating apparatus 100 can include a sensor 10 and a sensor controller 20 that controls the sensor 10. The sensor 10 can include a vessel 12 having an internal space communicating with the internal space of a vacuum chamber 1, a filament 16, a coil shaped grid 18, and an ion collector 19 arranged on the center line of the grid 18. The filament 16, the grid 18, and the ion collector 19 arranged in the internal space of the vessel 12. The filament 16 can be formed by coating an iridium surface with an yttrium oxide film. As the yttrium oxide film of this filament (to be referred to as the first type of filament hereinafter) deteriorates with use, the value of a current to be made to flow in the filament can increase. Alternatively, the filament 16 can be made of tungsten. As the diameter of this filament (to be referred to as the second type of filament hereinafter) decreases accompanying the evaporation of tungsten with use, the value of a current to be made to flow in the filament can decrease.

The sensor controller 20 can include a filament heating power supply 22, a filament bias power supply 28, a grid heating power supply 24, a grid bias power supply 26, an ion current detector 30, an emission current detector 34, a filament current detector 36, a pressure computer 32, a heating power supply controller 38, and a notification controller (controller) 40.

The filament heating power supply 22 supplies power for heating the filament 16 to the filament 16 so as to make the filament 16 emit electrons. The filament bias power supply 28 supplies a potential for maintaining the filament 16 at a predetermined potential to one terminal of the filament. The grid heating power supply 24 supplies power for heating the grid 18 to the grid 18. The grid bias power supply 26 supplies a potential for maintaining the grid 18 at a predetermined potential to the grid 18. The ion current detector 30 detects an ion current value Ii as the value of an ion current flowing into the ion collector 19. The emission current detector 34 detects an emission current value Ie as the value of an emission current flowing between the filament 16 and the grid 18.

The filament current detector 36 detects a filament current value If as the value of a filament current flowing through the filament 16. The filament current value If detected by the filament current detector 36 is a value having a correlation with the power supplied from the filament heating power supply 22 to the filament 16, and is repeatedly detected by the filament current detector 36. This value may be a current value itself or a value having a predetermined relation (for example, a proportional relation) with the current value. The value may be, for example, the voltage supplied between the two terminals of the filament 16 or a value having a predetermined relation (for example, a proportional relation) with the voltage. The value is, for example, the power supplied between the two terminals of the filament 16 or a value having a predetermined relation (for example, a proportional relation) with the power. In addition, the value may be, for example, the resistance value of the filament 16 or a value having a predetermined relation (for example, a proportional relation) with the resistance value.

The pressure computer 32 obtains a pressure by performing arithmetic calculation based on the ion current value Ii supplied from the ion current detector 30 and the emission current value Ie supplied from the emission current detector 34. The heating power supply controller 38 controls the voltage generated by the filament heating power supply 22 so as to control the filament current value If based on the emission current value Ie supplied from the emission current detector 34. The notification controller (controller) 40 determines whether the state of the filament 16 satisfies a notification condition, by using the plurality of filament current values If detected by the filament current detector 36. If the state satisfies the notification condition, the notification controller (controller) 40 performs notification to prompt to replace the filament 16.

The pressure computer 32, the heating power supply controller 38, and the notification controller (controller) 40 each can be implemented by a single or a plurality of processors. The processor can be implemented by, for example, a PLD (the abbreviation of a Programmable Logic Device) such as an FPGA (the abbreviation of a Field Programmable Gate Array), an ASIC (the abbreviation of an Application Specific Integrated Circuit), a general-purpose or dedicated computer incorporating programs, or a combination of all or some of them.

An operation of the electron generating apparatus 100 will be described below. First of all, the heating power supply controller 38 turns on the filament heating power supply 22 in response to the activation of the electron generating apparatus 100. The operation of turning on the filament heating power supply 22 can include providing a command value to the filament heating power supply 22. The heating power supply controller 38 can generate a command value provided to the filament heating power supply 22 so as to make the emission current value Ie quickly reach a reference current value Ier in the early stage in which the filament heating power supply 22 is turned on. This can shorten the time required to make the emission current value Ie reach the reference current value Ier.

The heating power supply controller 38 feedback-controls the filament heating power supply 22 to provide the filament heating power supply 22 with a command value corresponding to the difference (deviation) between the reference current value Ier and the emission current value Ie detected by the emission current detector 34 so as to match the emission current value Ie with the reference current value Ier.

The emission current value Ie detected by the emission current detector 34 and the ion current value Ii detected by the ion current detector 30 are supplied to the pressure computer 32. The pressure computer 32 can calculate a pressure according to equation (1). In this case, S is a constant, which corresponds to sensitivity.

$$P=(1/S)\cdot(Ii/Ie) \quad (1)$$

The pressure computer 32 can transmit the calculated pressure P to a pressure display unit and/or a main controller (neither shown).

Figure 2A:
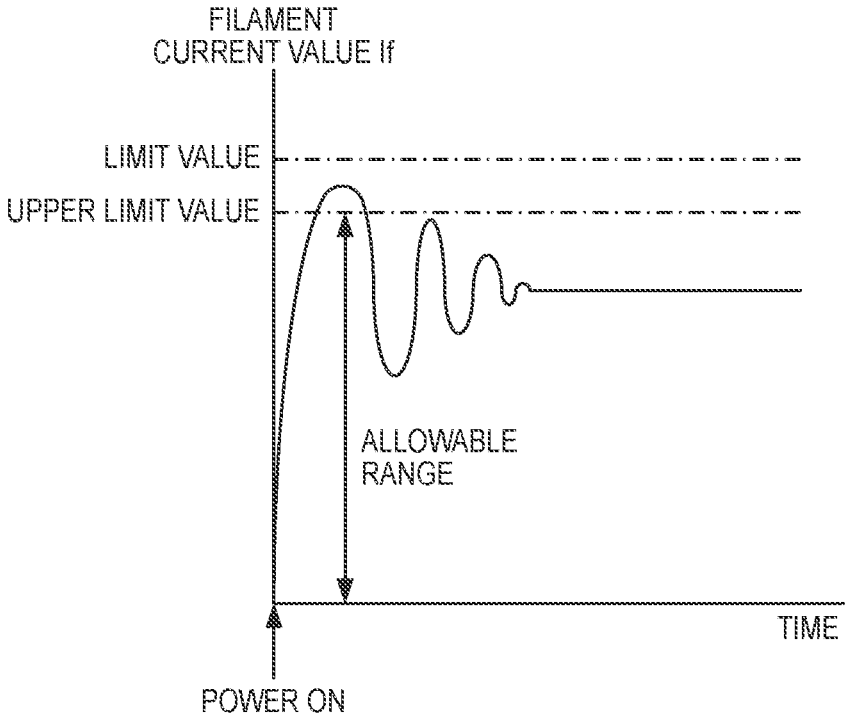

FIG. 2A exemplarily shows a change in the filament current value If detected by the filament current detector 36 immediately after the filament heating power supply 22 is turned on in a case in which the first type of filament is used as the filament 16. Referring to FIG. 2A, the term "allowable range" indicates the allowable range of the filament current value If that can flow in the filament 16, and the term "upper limit value" indicates the upper limit value of the allowable range.

When the filament current value If exceeds the upper limit value during the use of the electron generating apparatus 100, the notification controller 40 should perform notification to prompt to replace the filament 16. However, as described above, the filament current value If may exceed the upper limit value when a command value provided to the filament heating power supply 22 is generated to make the emission current value Ie quickly reach the reference current value Ier in the early stage in which the filament heating power supply 22 is turned on or when noise is generated. In such a case, when performing notification, the notification controller 40 performs notification to prompt to replace the filament 16 regardless of whether the service life of the filament 16 comes to an end.

Figure 2B:
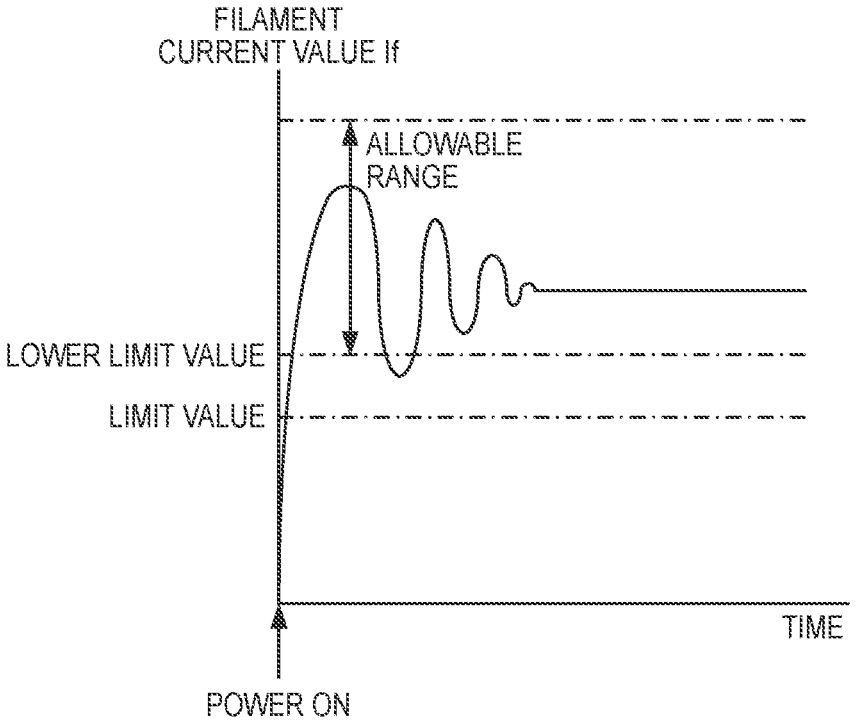

FIG. 2B exemplarily shows a change in the filament current value If detected by the filament current detector 36 immediately after the filament heating power supply 22 is turned on in a case in which the second type of filament is used as the filament 16. Referring to FIG. 2B, the term "allowable range" indicates the allowable range of the filament current value If that can flow in the filament 16, and the term "lower limit value" indicates the lower limit value of the allowable range.

When the filament current value If falls below the lower limit value during the use of the electron generating apparatus 100, the notification controller 40 should perform notification to prompt to replace the filament 16. However, as described above, the filament current value If detected by the filament current detector 36 may fall below the lower limit value when a command value provided to the filament heating power supply 22 is generated to make the emission current value Ie quickly reach the reference current value Ier in the early stage in which the filament heating power supply 22 is turned on or when noise is generated. In such a case, when performing notification, the notification controller 40 performs notification to prompt to replace the filament 16 regardless of whether the service life of the filament 16 comes to an end.

In the first embodiment of the present invention, the notification controller 40 repeatedly detects a value (in this case, the filament current value If) having a correlation with power supplied from the filament heating power supply 22 to the filament 16 by using the filament current detector 36. The notification controller 40 determines whether the state of the filament 16 satisfies a notification information, by using a plurality of values detected by using the filament current detector 36, and performs notification if the state satisfies the notification condition.

In this case, a detection unit that detects the voltage supplied to the filament 16 (the voltage supplied between the two terminals of the filament 16) may be used in place of the filament current detector 36. In this case, a value having a correlation with the power supplied from the filament heating power supply 22 to the filament 16 can be the voltage detected by the detection unit. Alternatively, a detection unit that detects the power supplied to the filament 16 may be used in place of the filament current detector 36. In this case, a value having a correlation with the power supplied from the filament heating power supply 22 to the filament 16 can be the power detected by the detection unit. Alternatively, a detection unit that detects the resistance value of the filament 16 may be used in place of the filament current detector 36. In this case, a value having a correlation with the power supplied from the filament heating power supply 22 to the filament 16 can be the resistance value detected by the detection unit. The resistance value can be detected by measuring the voltage or current supplied to the filament 16. Alternatively, a value having a correlation with the power supplied from the filament heating power supply 22 to the filament 16 may be the command value supplied from the heating power supply controller 38 to the filament heating power supply 22. Alternatively, a value having a correlation with the power supplied from the filament heating power supply 22 to the filament 16 may be a value that is not exemplarily shown here.

For example, if the arithmetic value obtained by arithmetically calculating a plurality of values each having a correlation with the power supplied from the filament heating power supply 22 to the filament 16 falls outside an allowable range, the notification controller 40 can determine that the notification condition is satisfied. The arithmetic value can be the intermediate value of a set of the plurality of values, for example, the mean value of the plurality of values. The mean value can be, for example, an arithmetic mean value, but may be another type of mean value. Alternatively, the arithmetic value may be an evaluation value or feature amount representing the shape of the waveform formed by the plurality of values.

The time required to detect a plurality of values, each having a correlation with the power supplied from the filament heating power supply 22 to the filament 16, from the first value to the last value, is set to be longer than the time taken for the power supplied to the filament 16 to reach the extreme value (the value at overshoot) for the first time after the filament heating power supply is turned on. The time required to detect the plurality of values from the first value to the last value can be, for example, 3 sec, 4 sec, 5 sec, 10 sec, 20 sec, or 30 sec.

Figure 3A:
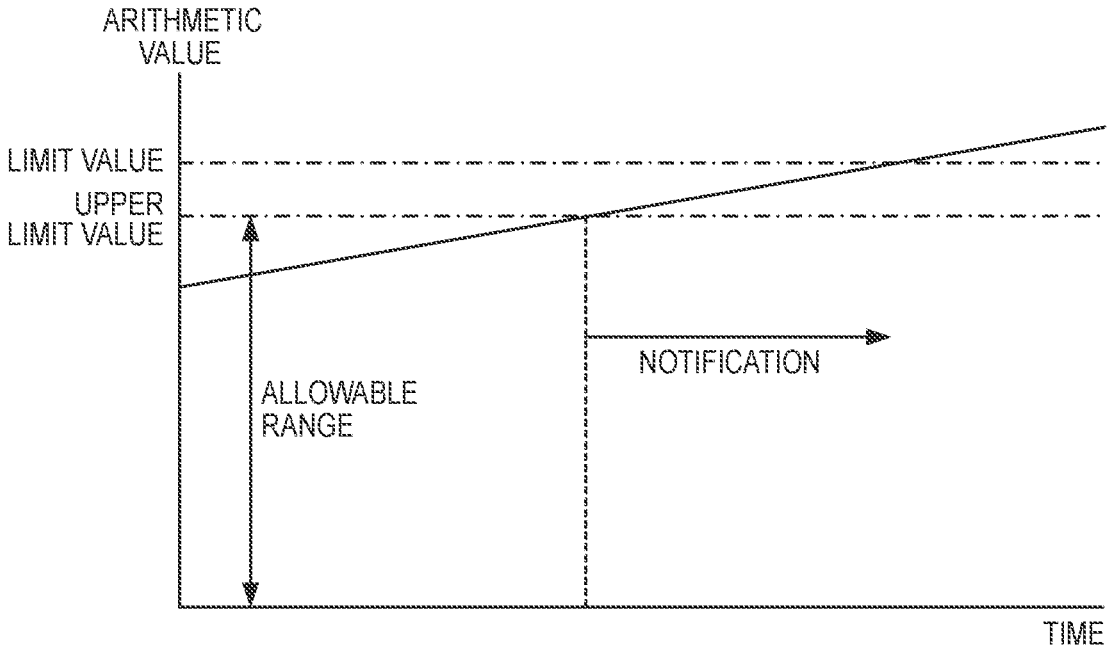
FIGS. 3A and 3B are graphs each exemplarily showing how notification is performed to prompt for filament replacement based on the arithmetic value obtained by arithmetically calculating a plurality of values each having a correlation with the power supplied to a filament (first embodiment)

FIG. 3A schematically shows arithmetic values and notification to prompt to replace the filament 16 based on the arithmetic values in a case in which the first type of filament is used as the filament 16. If the arithmetic value (for example, the mean value) obtained by arithmetically calculating a plurality of values each having a correlation with the power supplied from the filament heating power supply 22 to the filament 16 exceeds the upper limit value of the allowable range, the notification controller 40 can perform notification to prompt to replace the filament 16.

Figure 3B:
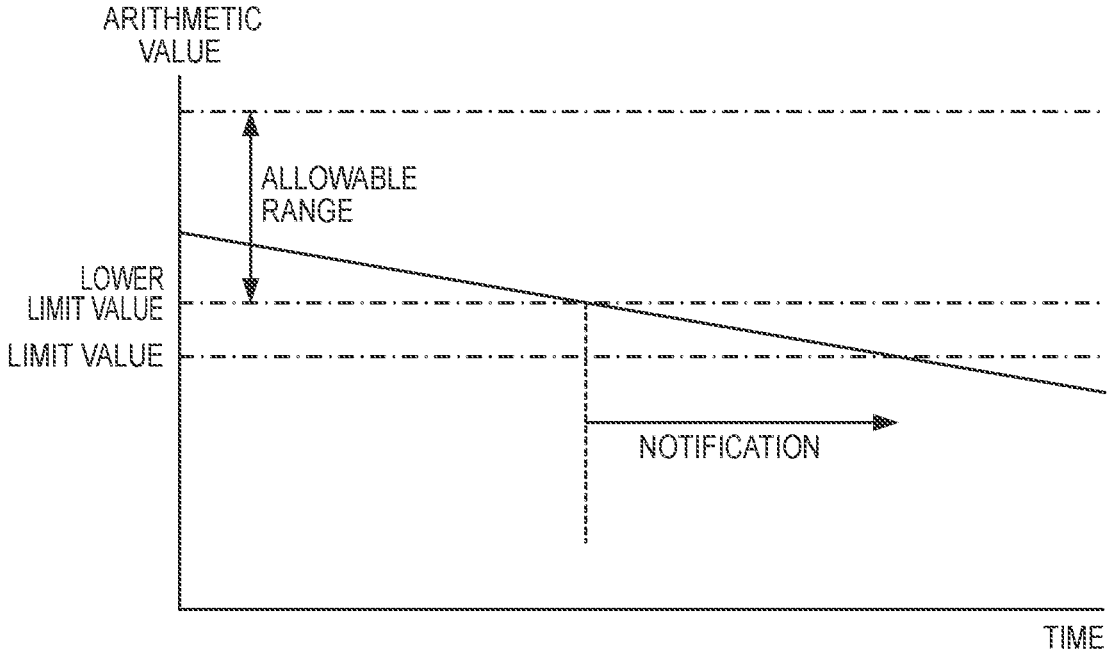

FIG. 3B schematically shows arithmetic values and notification to prompt to replace the filament 16 based on the arithmetic values in a case in which the second type of filament is used as the filament 16. If the arithmetic value (for example, the mean value) obtained by arithmetically calculating a plurality of values each having a correlation with the power supplied from the filament heating power supply 22 to the filament 16 falls below the lower limit value of the allowable range, the notification controller 40 can perform notification to prompt to replace the filament 16.

The second embodiment of the present invention will be described below with reference to FIGS. 4A and 4B. Matters that are not mentioned in the second embodiment can comply with the first embodiment. In the second embodiment, a notification controller 40 performs notification to prompt to replace the filament 16 based on a value having a correlation with the power supplied from a filament heating power supply 22 to a filament 16. In this case, the notification controller 40 does not perform notification to prompt to replace the filament 16 until the lapse of a predetermined time since the filament heating power supply 22 is turned on. This operation can be implemented by setting, as a non-observation period, a period until the lapse of a predetermined time since the filament heating power supply 22 is turned on and inhibiting the notification controller 40 from performing notification or inhibiting the notification controller 40 from operating during the non-observation period. The notification controller 40 can perform notification to prompt to replace the filament 16 based on a value having a correlation with the power supplied from the filament heating power supply 22 to the filament 16 in an observation period after the lapse of the predetermined period (non-observation period).

A value having a correlation with the power supplied from the filament heating power supply 22 to the filament 16 can fall outside the allowable range in part of the period until the lapse of the non-observation period since the filament heating power supply 22 is turned on. However, the notification controller 40 does not perform notification in the non-observation period. On the other hand, the notification controller 40 can perform notification to prompt to replace the filament 16 in response to a case in which a value having a correlation with the power supplied from the filament heating power supply 22 to the filament 16 falls outside the allowable range in an observation period after a non-observation period. Anon-observation period can be arbitrarily determined in accordance with the period required for the value to become stabilized after the filament heating power supply 22 is turned on. The time required for the value to become stabilized can be, for example, the period until the amount of change in the value per unit time falls within a predetermined range. Alternatively, a non-observation period can be determined in accordance with the time required for an emission current value Ie to reach a reference current value Ier since the filament heating power supply 22 is turned on.

Figure 4A:
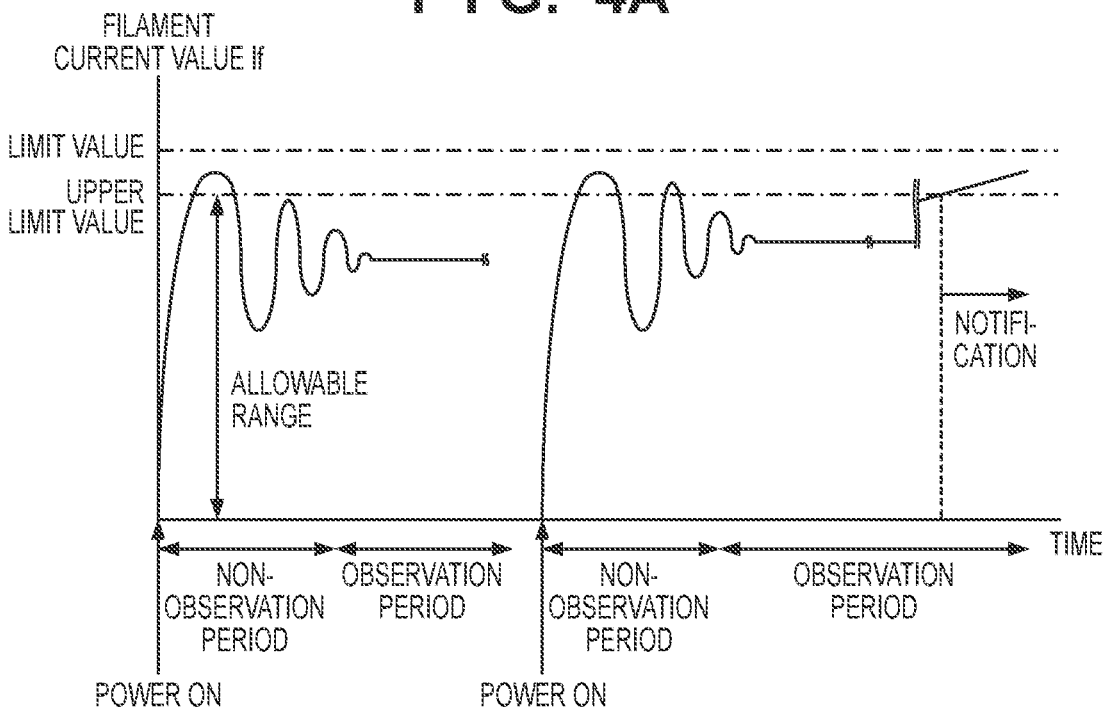
FIGS. 4A and 4B are graphs each exemplarily showing how notification is performed to prompt for filament replacement based on a value having a correlation with the power supplied from a filament heating power supply to a filament during an observation period after a non-observation period (second embodiment).

FIG. 4A schematically shows notification to prompt to replace the filament 16 based on a value (a filament current value If in this case) having a correlation with the power supplied from the filament heating power supply 22 to the filament 16 in a case in which the first type of filament is used as the filament 16. In the case shown in FIG. 4A, the notification controller 40 performs notification to prompt to replace the filament 16 in response to a case in which the filament current value If exceeds the upper limit of the allowable range in an observation period.

Figure 4B:
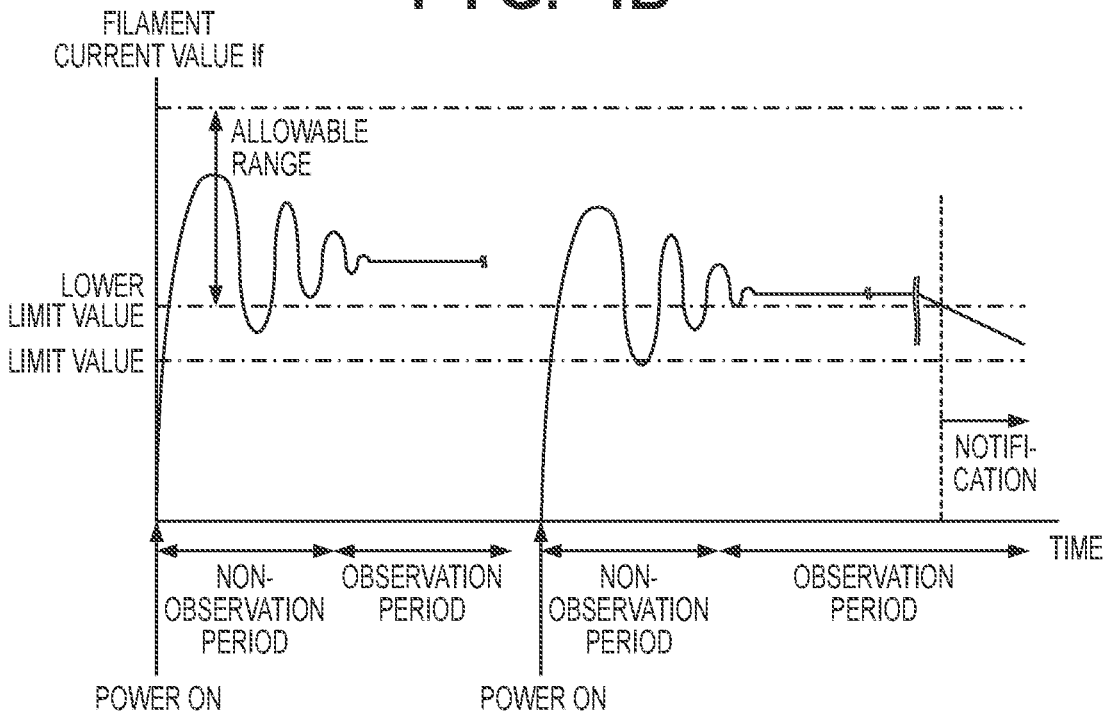

FIG. 4B schematically shows notification to prompt to replace the filament 16 based on a value (a filament current value If in this case) having a correlation with the power supplied from the filament heating power supply 22 to the filament 16 in a case in which the second type of filament is used as the filament 16. In the case shown in FIG. 4B, the notification controller 40 performs notification to prompt to replace the filament 16 in response to a case in which the filament current value If falls below the lower limit of the allowable range in an observation period.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-170777, filed Sep. 19, 2019, which is hereby incorporated by reference herein in its entirety.

What is claimed is:

1. An electron generating apparatus comprising:

a filament;

a power supply configured to supply power to the filament so as to make the filament emit an electron; and a controller configured to repeatedly detect a value having a correlation with power supplied from the power supply to the filament, determine whether a state of the filament satisfies a notification condition, by using a plurality of detected values, and perform notification when the state satisfies the notification condition.

2. The apparatus according to claim 1, wherein when an arithmetic value obtained by arithmetically calculating the plurality of values falls outside an allowable range, the notification condition is satisfied.

3. The apparatus according to claim 2, wherein the arithmetic value is an intermediate value of a set of the plurality of values.

4. The apparatus according to claim 3, wherein an intermediate value of the set is a mean value of the plurality of values.

5. The apparatus according to claim 1, wherein when an arithmetic value obtained by arithmetically calculating the plurality of values exceeds an upper limit value, the notification condition is satisfied.

6. The apparatus according to claim 1, wherein when an arithmetic value obtained by arithmetically calculating the plurality of values falls below a lower limit value, the notification condition is satisfied.

7. The apparatus according to claim 1, wherein a time required to detect the plurality of values from the first value to the last value is longer than a time until power supplied to the filament reaches an extreme value first after the power supply is turned on.

8. The apparatus according to claim 1, wherein the time required to detect the plurality of values from the first value to the last value is longer than 3 sec.

9. An ionization gauge comprising an electron generating apparatus defined in claim 1.

10. The apparatus according to claim 1, wherein the filament has first and second terminals, and the filament heating power supply has third and fourth terminals electrically connected to the first and second terminals, respectively, so as to form a current path from the first terminal to the fourth terminal via the filament, and wherein the controller is configured to repeatedly detect a value having a correlation with power supplied from the filament heating power supply to the filament through the entirety of the current path.

11. The apparatus according to claim 10, wherein the power supply is a filament heating power supply, and the apparatus further comprising:

a grid;

an ion collector;

an emission current detector configured to detect a value of an emission current flowing between the filament and the grid;

a filament bias power supply configured to supply a predetermined potential to one terminal of the filament;

a heating power supply controller configured to control the voltage generated by the filament heating power supply so as to control a value of a filament current flowing through the current path based on the value of the emission current detected by the emission current detector.

12. The apparatus according to claim 11, wherein the heating power supply controller is configured to generate a command value provided to the filament heating power supply so as to make a value of the emission current quickly reach a reference current value in an early stage in which the filament heating power supply is turned on, and wherein the heating power supply controller is further configured to feedback-control the filament heating power supply to provide the filament heating power supply with a command value corresponding to the difference between the reference current value and the value of the emission current detected by the emission current detector so as to match the value of the emission current with the reference current value.

13. An electron generating apparatus comprising:

a filament;

a power supply configured to supply power to the filament so as to make the filament emit an electron; and a controller configured to perform notification to prompt to replace the filament based on a value having a correlation with power supplied from the power supply to the filament, wherein the controller does not perform the notification until a lapse of a predetermined time since the power supply is turned on.

14. The apparatus according to claim 13, wherein the value falls outside the allowable range in part of a period until the lapse of the predetermined time since the power supply is turned on, and the controller performs the notification in response to a case in which the value falls outside the allowable range.

15. The apparatus according to claim 13, wherein the predetermined time is determined in accordance with a time required until the value is stabilized after the power supply is turned on.

16. An ionization gauge comprising an electron generating apparatus defined in claim 13.

17. The apparatus according to claim 13, wherein the filament has first and second terminals, and the filament heating power supply has third and fourth terminals electrically connected to the first and second terminals, respectively, so as to form a current path from the first terminal to the fourth terminal via the filament, and wherein the controller is configured to repeatedly detect a value having a correlation with power supplied from the filament heating power supply to the filament through the entirety of the current path.

18. The apparatus according to claim 17, wherein the power supply is a filament heating power supply, and the apparatus further comprising:

a grid;

an ion collector;

an emission current detector configured to detect a value of an emission current flowing between the filament and the grid;

a filament bias power supply configured to supply a predetermined potential to one terminal of the filament;

a heating power supply controller configured to control the voltage generated by the filament heating power supply so as to control a value of a filament current flowing through the current path based on the value of the emission current detected by the emission current detector.

19. The apparatus according to claim 18, wherein the heating power supply controller is configured to generate a command value provided to the filament heating power supply so as to make a value of the emission current quickly reach a reference current value in an early stage in which the filament heating power supply is turned on, and wherein the heating power supply controller is further configured to feedback-control the filament heating power supply to provide the filament heating power supply with a command value corresponding to the difference between the reference current value and the value of the emission current detected by the emission current detector so as to match the value of the emission current with the reference current value.

* * * * *